US006110057A

United States Patent [19]

McKinnon

[11] Patent Number: 6,110,057

[45] Date of Patent: Aug. 29, 2000

[54] JIRO PUTTER

[76] Inventor: Alexander McKinnon, 618 3rd St. SW., Washington, D.C. 20024

[21] Appl. No.: 09/337,416

[22] Filed: Jun. 22, 1999

[51] Int. Cl.[7] ..... A63B 53/02; A63B 53/04

[52] U.S. Cl. ..... 473/313; 473/314; 473/330; 473/331; 473/340

[58] Field of Search ..... 473/340, 341, 473/313, 324, 329, 330, 337, 342, 331

[56] References Cited

U.S. PATENT DOCUMENTS

| | | | |
|---|---|---|---|
| D. 55,278 | 5/1920 | Kraeuter . | |
| D. 57,980 | 5/1921 | Kraeuter . | |
| D. 63,284 | 11/1923 | Challis . | |
| D. 122,795 | 10/1940 | Geerlings . | |
| D. 350,582 | 9/1994 | Miansian et al. . | |
| D. 385,935 | 11/1997 | Cameron . | |
| 838,763 | 12/1906 | Austin | 273/123 R |
| 1,454,267 | 5/1923 | Challis et al. . | |
| 1,503,291 | 7/1924 | Rimmer . | |
| 1,666,174 | 4/1928 | Holland . | |
| 4,183,527 | 1/1980 | Amburgey . | |
| 4,964,641 | 10/1990 | Miesch | 473/330 |
| 5,332,225 | 7/1994 | Ura . | |
| 5,425,538 | 6/1995 | Vincent et al. . | |
| 5,620,381 | 4/1997 | Spalding . | |
| 5,688,190 | 11/1997 | Rowland et al. . | |
| 5,735,755 | 4/1998 | Kobayashi . | |
| 6,007,434 | 12/1999 | Baker | 473/330 |

FOREIGN PATENT DOCUMENTS

| | | |
|---|---|---|
| WO 93/00968 | 1/1993 | WIPO . |

*Primary Examiner*—Jeanette Chapman
*Assistant Examiner*—Stephen L. Blau
*Attorney, Agent, or Firm*—Richard C. Litman

[57] ABSTRACT

An improved golf putter which includes a shaft having an enlarged gripping portion and a putting head having an array of hollow rigid spikes projecting from the face of the putting head. The spikes are designed to impart an immediate rolling or top spin motion to the golf ball. The putting head is positioned on the shaft in a precise manner so that the putter is exceptionally balanced. The spikes can be attached to a separate plate which plate may be attached to existing putters.

20 Claims, 5 Drawing Sheets

JIRO PUTTER

BACKGROUND OF THE INVENTION

1. Field of the Invention

The present invention generally relates to golf clubs. More specifically, the present invention is drawn to an improved golf putter having an enlarged grip and modified ball-striking face.

2. Description of the Related Art

In most instances, the "bogey", "double bogey", or (horrors) "triple bogey" is the result of faulty putting. Thus, the putter has attained the status of the club most likely to be replaced in the golf bag. Many putter designs have evolved over the years but there remains a mystique about putting that adversely affects the professional, amateur, and duffer.

Examples of designated putter designs are disclosed in U.S. Pat. No. Des. 57,980 (Kraeuter), U.S. Pat. No. Des. 63,284 (Challis), 1,454,267 (Challis et al.), U.S. Pat. No. 1,503,291 (Rimmer), U.S. Pat. No. 1,666,174 (Holland), U.S. Pat. No. 5,332,225 (Ura) shows a device for practicing the putting stroke.

U.S. Pat. No. Des. 55,278 (Kraeuter), U.S. Pat. No. Des. 122,795 (Geerlings), U.S. Pat. No. Des. 350,582 (Miansian et al.), U.S. Pat. Des. 385,935 (Cameron), U.S. Pat. No. 5,425,538 (Vincent et al.), U.S. Pat. No. 5,688,190 (Rowland et al.), U.S. Pat. No. 5,735,755 (Kobayashi), and WIPO Patent WO 93/00968 are cited to show designs and structure for golf clubs designated as irons or woods.

U.S. Pat. No. 4,183,527 (Amburgey) shows a gyroscopically balanced bowling ball.

U.S. Pat. No. 5,620,381 (Spalding) shows a putter having a plurality of fine spring wire on the putting face.

None of the above inventions and patents however, taken either singularly or in combination, is seen to disclose a putter having an enlarged grip and spiked face as will be subsequently described and claimed in the instant invention.

SUMMARY OF THE INVENTION

The instant invention is a golf putter comprising a shaft with an enlarged gripping portion at one end and a novel low profile putter head precisely positioned at the other end. The enlarged grip and putter head positioning enhances the "feel" of the putter and gives it balance similar to that of an expensive pen or a superior brush used by an artist.

According to many golf experts, it is important to get a golf ball rolling as early in the putting stroke as possible as opposed to the ball sliding or scooting over the putting green. A rolling ball will more likely follow the direction of the putting stroke rather than the direction defined by the grain of the grass, even on a slanted or downhill putting green. Also the inertia of a rolling ball is less likely to be influenced by small imperfections in the putting green's surface. To this end, the instant invention incorporates an array of hollow rigid spikes positioned on the ball striking face of the putter's low profile head. When executing the putting stroke, the spikes will tend to "bite" into the ball and immediately impart a rolling or top spin motion to the ball. The face of the putter will be in contact with the ball a fraction of a second longer than on a conventional putter giving the golfer substantially more control on putting alignments.

The enlarged grip, balanced head, and spiked face combine to produce a superior putter which prevents glancing, ricocheting, and scooting problems. The putter of the instant invention also minimizes the tendency to pull or push the ball out of alignment with a direct path to the hole. The putting confidence instilled in the user may well spill over into other aspects of the game.

The improved putter will be economical to manufacture and easy to use. Because of the reduction of putting strokes, tournament and television time will be shortened with benefits accruing to all segments of the golfing public.

Accordingly, it is a principal object of the invention to provide an improved golf putter.

It is another object of the invention to provide a golf putter having an improved gripping surface.

It is a further object of the invention to provide a golf putter having an effectively balanced head.

Still another object of the invention is to provide a golf putter having a striking face which imparts immediate rolling motion to a struck golf ball.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
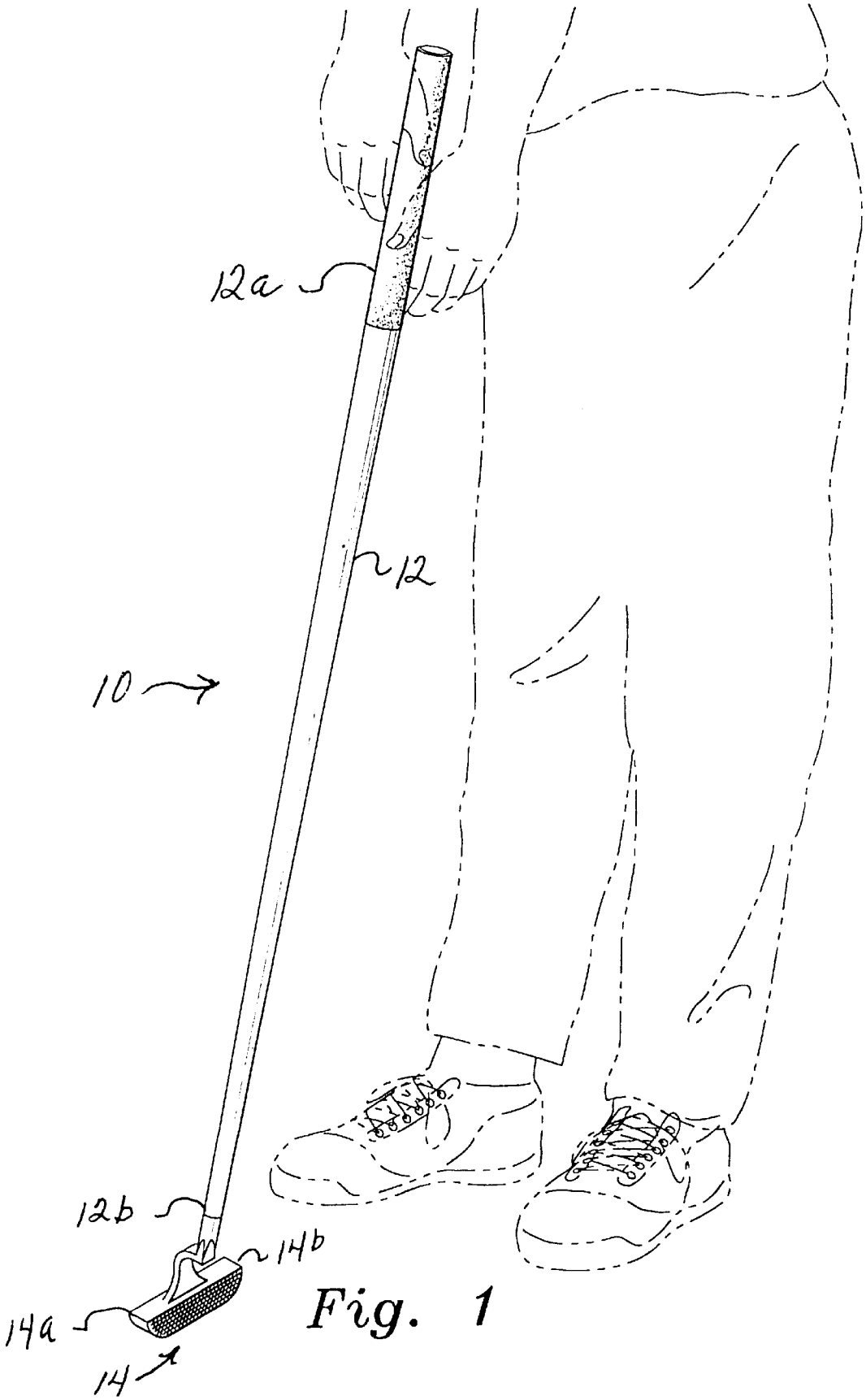
FIG. 1 is an environmental perspective view of a putter according to the present invention.

Attention is directed to FIG. 1 which shows a golf putter generally indicated at 10. Putter 10 includes a shaft 12. Shaft 12 is approximately thirty-five inches long. A gripping portion 12*a* defines the upper end of the shaft. The gripping portion extends approximately fourteen inches downward from the top of the shaft. To ensure a more secure grasp, the circumference of portion 12*a* is approximately six inches. The shaft tapers from upper portion 12*a* to a lower portion 12*b*, which lower portion has a circumference of approximately one-half inch.

A putter head 14 is attached to the lower end 12*b* of shaft 12. The front end or toe of putter head 14 is designated at 14*a*. The rear end or heel of putter head 14 is designated at 14*b*. To attain optimum balance, it has been determined that the toe 14*a* should be horizontally positioned a distance of one and one-half inches from the longitudinal axis of shaft 12. Heel 14*b* should be horizontally positioned a distance one inch from the longitudinal axis. The shaft and putter head can be fabricated from motel, plastic, or even some type of stone.

Figure 2:
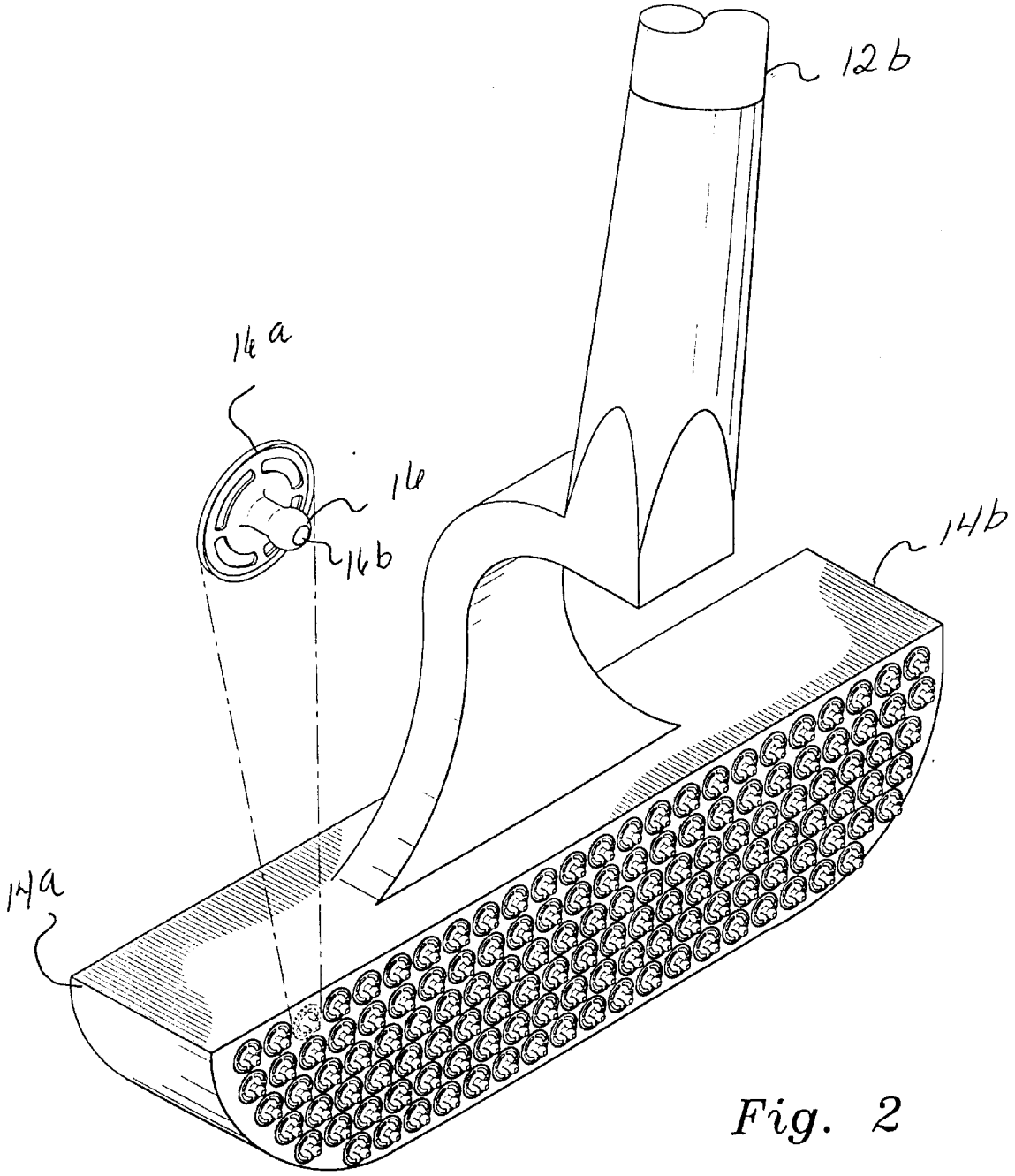
FIG. 2 is a detailed plan view of a first embodiment of the spiked face of a putter according to the present invention.
Figure 3:
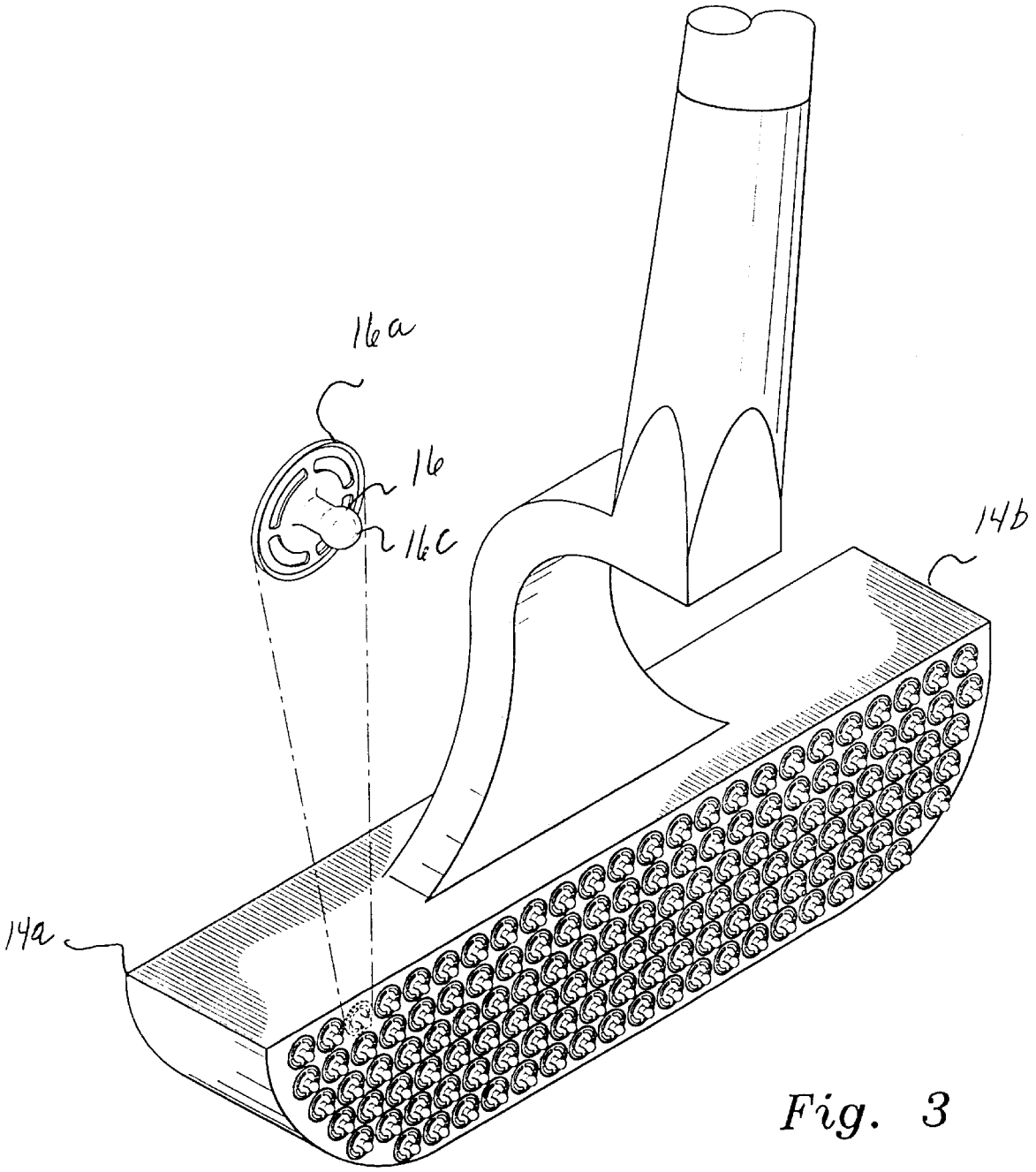
FIG. 3 is a detailed plan view of a second embodiment of the spiked face of a putter according to the present invention.
Figure 4:
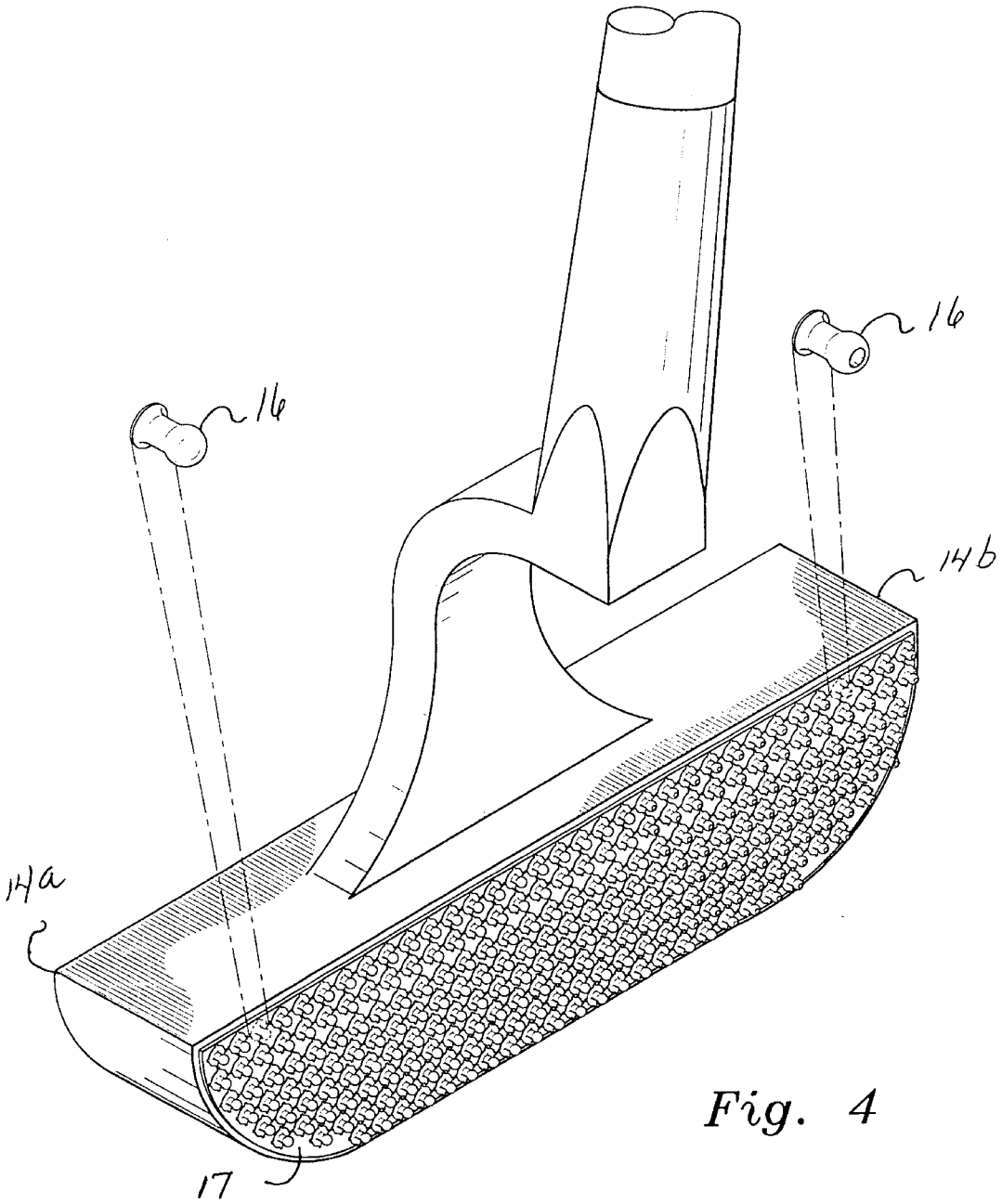
FIG. 4 is a detailed plan view of a third embodiment of third embodiment of the spiked face of a putter according to the present invention.

An array of hollow rigid spikes 16 is attached to the ball striking face of putter head 14. As best seen in FIGS. 2–4, the spikes 16 are arrayed in uniform spaced rows, the spaces between the rows forming grooves. The array however, may be formed irregularly.

In an embodiment of the invention specific to FIG. 2, spikes 16 are integrally mounted to a base portion 16*a*. Base 16*a* is affixed to the putter head face in any convenient and efficient manner (glue, weld, etc.). Each spike of the array is formed with an opening 16*b* at its free end. The opening may be slightly flared at the tip.

The embodiment as depicted in FIG. 3 is the same as that of FIG. 2 with the exception that each spike is closed at its free end 16*c*.

In order to adapt the inventive concept to existing putters, the spikes 16 may be affixed to a plate 17 as shown in FIG. 4. The plate 17 may then be attached to existing putter heads. It should be noted that the spikes of the instant embodiment do not require a base portion and may be of the open end or closed end type.

Figure 5:
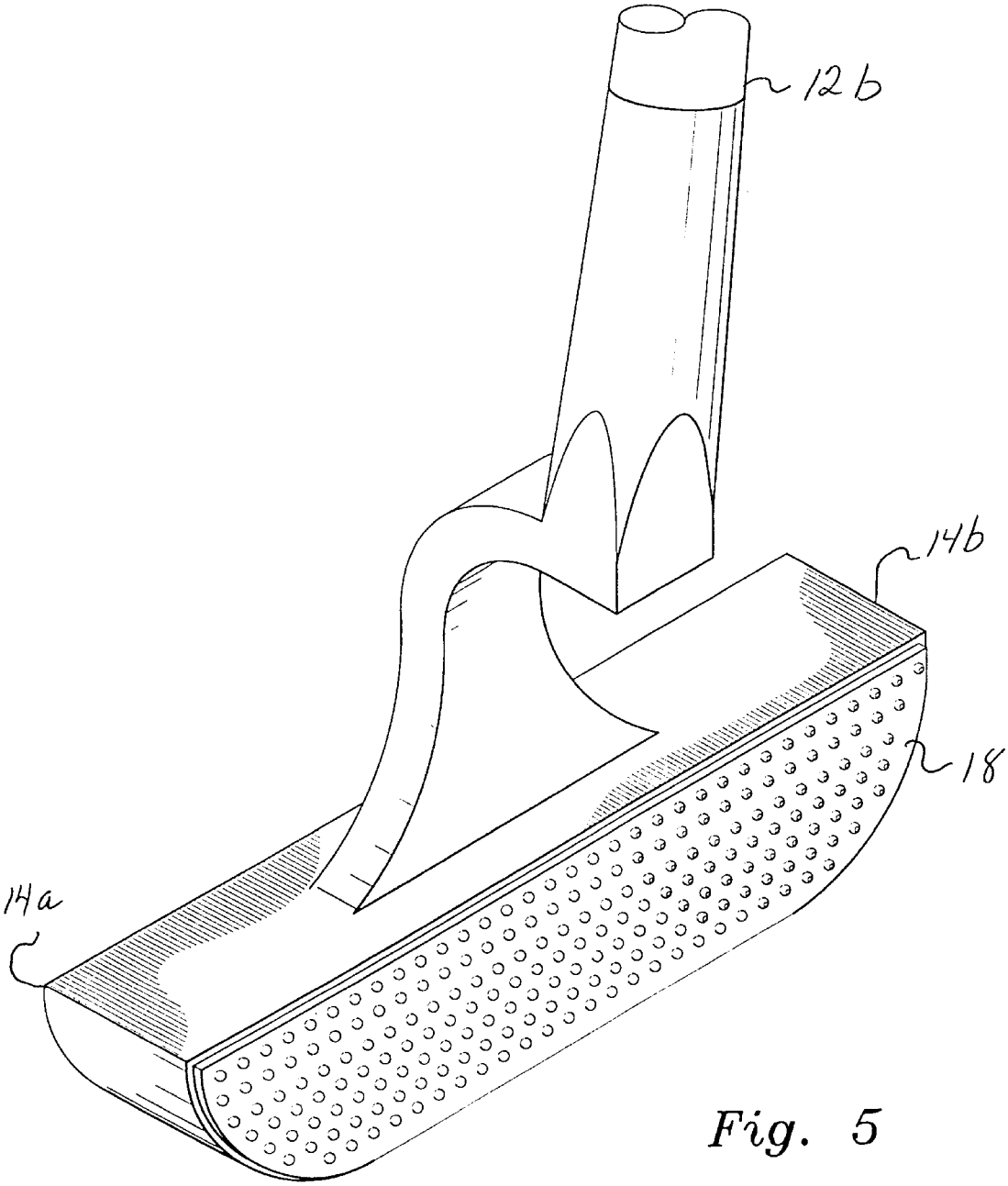
FIG. 5 is a detailed plan view of a fourth embodiment of the spiked face of a putter according to the present invention.

In FIG. 5, the spaces between each row of spikes 16 is filled with a material 18 to a height just below the free ends of the spikes thereby eliminating the grooves and providing for a different "feel" when putting.

Spikes 16, bases 16*a*, plate 17, and fill material 18 may be fabricated of metal or plastic in any of the disclosed variations. The choice of which material or variation will be decided by the user based on the type of "feel" desired. The spikes may be made in various colors (silver, gold, black, brass, etc.) to satisfy any aesthetic requirements.

It is to be understood that the present invention is not limited to the embodiments described above, but encompasses any and all embodiments within the scope of the following claims.

I claim:

1. A golf putter comprising:

an elongated shaft, said shaft having an upper end and a lower end;

a gripping surface disposed on said upper end of said shaft;

a putter head, said putter head attached to said lower end of said shaft;

said upper end of said shaft having a circumference substantially greater than a circumference defined by said lower end of said shaft;

a ball striking face formed on said putter head; and an array of spaced hollow rigid spikes attached to said ball striking face and extending perpendicularly therefrom, each spike of said array being substantially the same length and having a free end, said array being aligned in rows whereby a space is formed between each row.

2. A golf putter as defined in claim 1, wherein a material is disposed to fill the space between each row.

3. A golf putter as defined in claim 2, wherein said material is plastic.

4. A golf putter as defined in claim 2, wherein said material is metal.

5. A golf putter as defined in claim 1, wherein said array of spikes is attached to a planar member and said planar member is attached to said ball striking face.

6. A golf putter as defined in claim 1, wherein said free end of each spike is closed.

7. A golf putter as defined in claim 6, wherein said array of rigid spikes is made of metal.

8. A golf putter as defined in claim 6, wherein said array of rigid spikes is made of plastic.

9. A golf putter as defined in claim 1, wherein said free end of each spike is formed with an opening.

10. A golf putter as defined in claim 9, wherein said array of rigid spikes is made of metal.

11. A golf putter as defined in claim 9, wherein said array of rigid spikes is made of: plastic.

12. A golf putter, said golf putter comprising:

an elongated shaft, said shaft having an upper end, a lower end, and a longitudinal central axis;

a gripping surface disposed on said upper end of said shaft;

a putter head, said putter head attached to said lower end of said shaft and extending substantially perpendicular thereto;

a toe portion defining a first end of said putter head;

a heel portion defining a second end of said putter head;

said upper end of said shaft having a circumference substantially greater than a circumference defined by said lower end of said shaft;

a ball striking face formed on said putter head; and an array of spaced rigid hollow spikes attached to said ball striking face and extending perpendicularly therefrom, each spike of said array being substantially the same length and having a free end.

13. A golf putter as defined in claim 12, wherein said toe portion is horizontally spaced a distance of one and a half inches from the central axis of said shaft.

14. A golf putter as defined in claim 13, wherein said heel portion is horizontally spaced a distance of one inch from the central axis of said shaft.

15. A golf putter as defined in claim 14, wherein said free end of each spike is closed.

16. A golf putter as defined in claim 15, wherein said array of rigid spikes is made of metal.

17. A golf club as defined in claim 15, wherein said array of rigid spikes is made of plastic.

18. A golf putter as defined in claim 14, wherein said free end of each spike is formed with an opening.

19. A golf putter as defined in claim 18, wherein said array of rigid spikes is made of metal.

20. A golf putter as defined in claim 18, wherein said array of rigid spikes is made of plastic.

* * * * *